United States Patent [19]

Guéry et al.

[11] Patent Number: 4,489,296

[45] Date of Patent: Dec. 18, 1984

[54] DEVICE FOR RESILIENTLY HOLDING A CONTACT BRIDGE

[75] Inventors: Jean-Pierre Guéry, Poissy; André Zwarycz, Rueil Malmaison, both of France

[73] Assignee: La Telemecanique Electrique, France

[21] Appl. No.: 449,904

[22] Filed: Dec. 15, 1982

[30] Foreign Application Priority Data

Dec. 15, 1981 [FR] France ..... 81 23378

[51] Int. Cl.[3] ..... H01H 1/50

[52] U.S. Cl. ..... 335/197; 335/132; 200/243

[58] Field of Search ..... 335/197, 198, 132, 131; 200/243, 280, 281

[56] References Cited

U.S. PATENT DOCUMENTS

| | | | |
|---|---|---|---|
| 3,646,491 | 2/1972 | Puetz | 335/197 |
| 3,740,510 | 6/1973 | Grunert | 335/132 |
| 3,964,006 | 6/1976 | Lacan | 335/132 |

FOREIGN PATENT DOCUMENTS

| | | | |
|---|---|---|---|
| 1322323 | 2/1962 | France | 200/280 |
| 859625 | 11/1957 | United Kingdom | 335/132 |

*Primary Examiner*—E. A. Goldberg
*Assistant Examiner*—George Andrews
*Attorney, Agent, or Firm*—William A. Drucker

[57] ABSTRACT

A movable contact bridge (12) is associated with contact carrier (7) by means of a stirrup (28), a pressure spring (25) and a resilient blade (45). The stirrup has two hooks (35, 36) which hold the blade in place and facilitate removal and positioning thereof because of the gap (60) separating these hooks. This contact bridge is advantageously used in contactors of minimum rated power greater than 100 amps.

3 Claims, 6 Drawing Figures

DEVICE FOR RESILIENTLY HOLDING A CONTACT BRIDGE

BACKGROUND OF THE INVENTION

The present invention relates to a device for resiliently holding a contact, said device comprising an insulating contact carrier, having a column with at its top a bearing surface onto which opens an internal housing adapted to receive bearingly a pressure spring, a mobile contact bridge whose central surface is placed opposite the bearing surface and U-shaped coupling stirrup whose parallel legs, provided with hooks and connected to a common crosspiece, surround the contact bridge so as to communicate thereto a bearing force on fixed contacts through a resilient blade which is placed on this contact bridge and which has a central notch adapted to cooperate with a rib of the stirrup.

THE PRIOR ART

Such holding devices are in particular used for resiliently holding in place contact bridges of electromagnetic contactors. In a known contact bridge holding device, corresponding to the general above-mentioned construction, curved hooks of the stirrup engage on a mobile turn positioned at the end of the spring, whereas the common crosspiece is applied on a resilient blade through the surface of the contact bridge.

Since this continuous crosspiece has a centering rib which cooperates with a notch for holding the resilient blade in position, it is not convenient to communicate by pressure, to the central region of this blade, a deformation allowing the notch to escape from the rib, which deformation is necessary for removing or exchanging a contact bridge.

In another known contact bridge resilient holding device, a stirrup has two legs which pass inside a contact pressure spring, and whose curved ends cooperate with a bearing washer intended to receive the mobile turn of the spring; this device does not allow easy assembly to the extent that this washer must be positioned when the spring is placed in the housing of the contact carrier, and it is fitted into this housing in a direction opposite that which the stirrup must follow to penetrate into this same housing.

OBJECT OF THE INVENTION

It is an object of the invention to propose a device for resiliently holding a contact bridge in which arrangements are made to facilitate dismantling of the contact bridge without adversely effecting the convenience of assembly of a contact holder in the factory.

SUMMARY OF THE INVENTION

According to this invention, this result is obtained because the crosspiece common to the two legs of the stirrup bears directly on the mobile turn of the spring, whereas the two hooks which are directed towards each other transversely with respect to the axis XX' of the spring, and are separated by a gap, pass above the bearing surface.

DESCRIPTION OF THE PREFERRED EMBODIMENT

Figure 1:
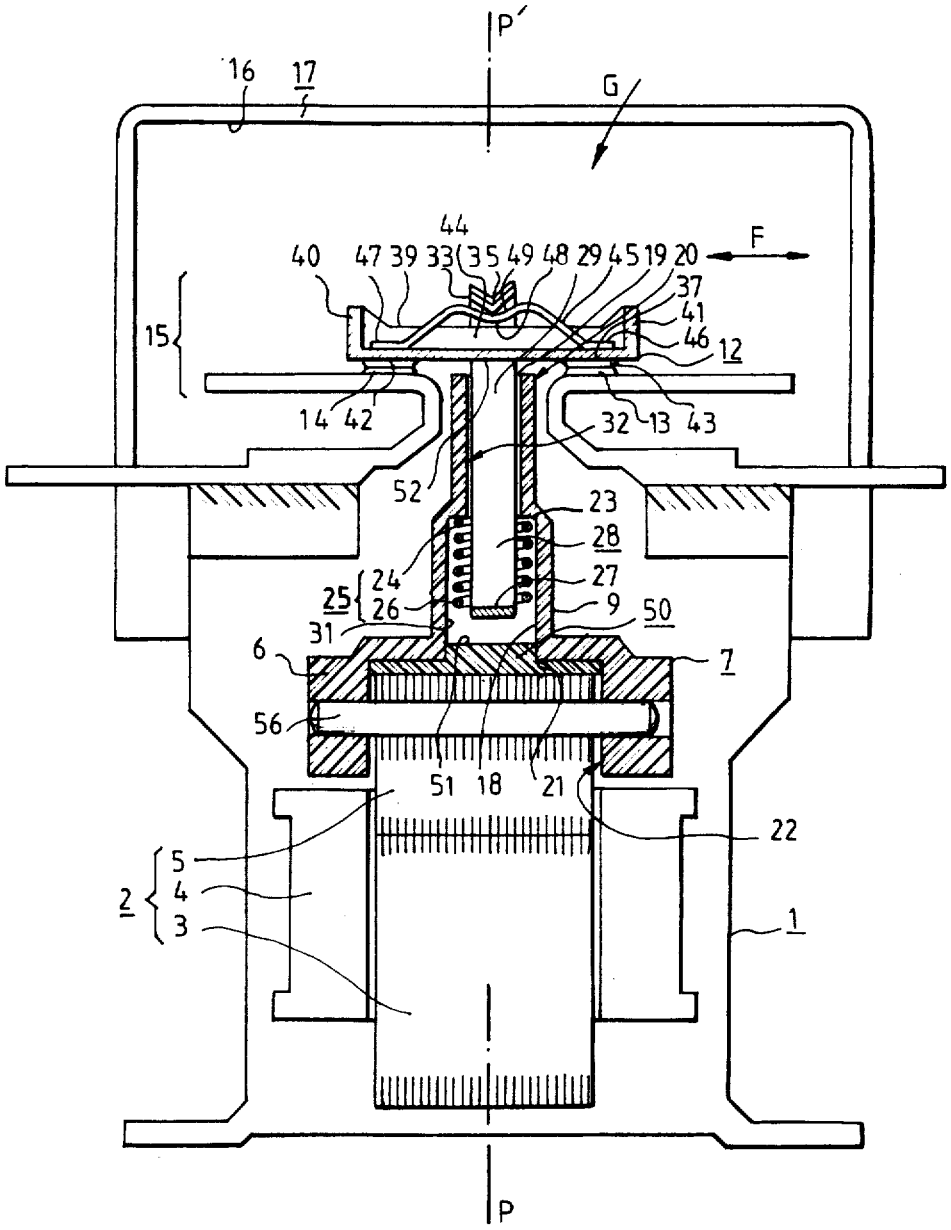
FIG. 1 shows in elevation, a sectional view of the device through a plane QQ' containing the axis of the spring and a mobile contact bridge, in the closed position, belonging to a contactor.

A contactor using the device of the invention as shown in FIG. 1, comprises principally a body 1 in which is disposed an electromagnet 2 having a fixed yoke 3, a coil 4 and a mobile armature 5. This latter is associated with the lower part 6 of a contact carrier 7 whose movements, in plane PP', are guided by means not shown. The upper part 8 of the contact carrier comprises several identical parallel columns 9, 10, 11, each carrying a contact bridge such as 12, see also FIG. 2.

This contact bridge 12 cooperates with fixed contacts 13, 14 so as to form a power switch 15 which is housed in a compartment 16 belonging to a series of parallel compartments disposed in an insulating box 17 fixed to the body.

Column 9 has passing therethrough a housing 18 which extends over the whole of its length and which opens through an upper opening 19 at a bearing surface 20 and through a lower opening 21 into a cavity 22 which receives the armature. This housing 18 has two transverse widths so as to form a shoulder 23 which is turned towards cavity 22 and on which bears a fixed turn 24 of a contact pressure spring 25; the mobile turn 26 of this spring bears in its turn on a crosspiece 27 of the stirrup 28 having two parallel legs 29, 30 which give it the general shape of a U, see FIG. 2.

Stirrup 28 is placed partly in a lower portion 31 of housing 18 which receives the spring and partly in an upper portion 32 of this housing.

Two upper ends 33, 34 of these legs, which are placed above the bearing surface 20, each have a hook 35, respectively 36, which is oriented towards the other hook; a gap 60 separates the end of the facing hooks.

The contact bridge 12 which is shown in FIG. 1, in the position of closure of the switch 15, has the form of a cup with a bottom 37, two sidewalls 38, 39 and two arcing horns 40, 41; the mobile contacts inserts 42, 43 are disposed on the outer surface of bottom 37, whereas the inner volume 44 of the cup receives a resilient blade 45. This resilient blade has two ends 46, 47 which bear on the bottom in the vicinity of the arcing horns, and a central bulging region 48 which has a notch 49.

Figure 2:
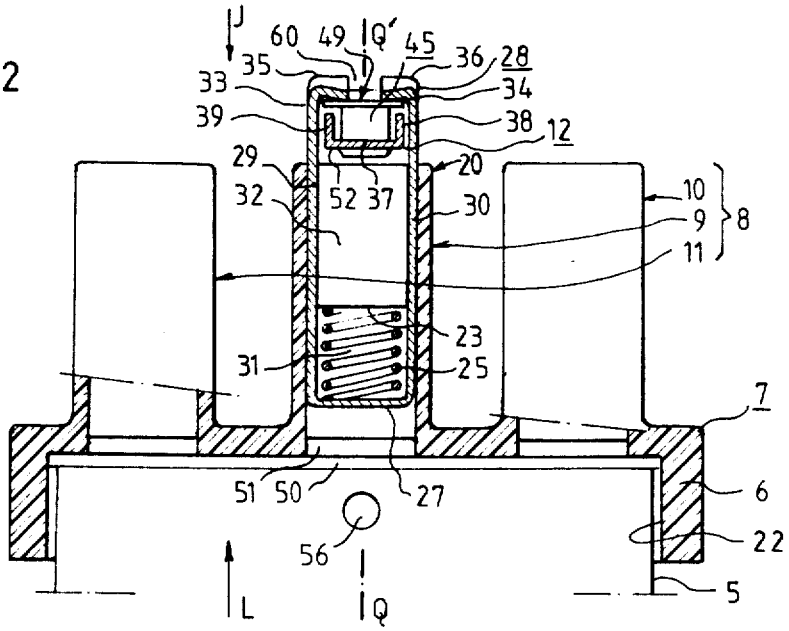
FIG. 2 shows a side view of FIG. 1 in which only a column of the contact carrier and a corresponding contact bridge have been shown in section through a plane PP'.

The contact bridge 12 is placed between legs 29, 30 of the stirrup, see FIG. 2, so that hooks 35, 36 engage in the notch 49 of the resilient blade; a contact pressure force developed by the compression of spring 25 is then transmitted to the contact bridge 12 through the stirrup 28 and the resilient blade 45.

An examination of FIG. 1 shows that the crosspiece 27 of the metal stirrup 28 is placed in the vicinity of armature 5; it is then necessary to insert between these two parts insulating means for preventing the appearance of leak currents or arcs which would tend to appear between two neighboring switches through the armature.

The means used consists in an insulating part 50, see also FIG. 2, having a boss 51 which penetrates into the lower portion 31 of housing 18, which bears on the armature, and which is adapted to serve as an abutment for the crosspiece 27.

Figure 5:
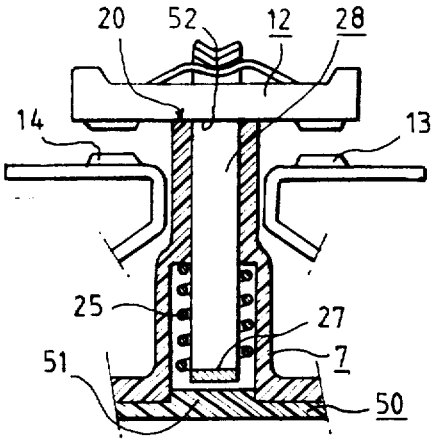
FIG. 5 shows in elevation a local section through plane QQ' when the switch is open.

When the contact bridge is in place and the switch is open, see FIG. 5, the central region 52 of the bottom 37 of the contact bridge is applied against the bearing surface 20 by the pressure spring 25, and the crosspiece 27 does not engage with the insulating piece 50, 51.

Removal of a contact bridge 12 may be effected, for example, when the contact bridge is bearing on the fixed contact. For this, a pressure in direction G is exerted between the hooks and in gap 60 by means of a simple tool on the central region of the resilient blade 45 (and in particular on the bottom 57 of groove 49) so as to deform this blade and allow this groove to escape from the hooks; removal of the contact bridge is then effected by a lateral thrust exerted in direction F.

Figure 3:
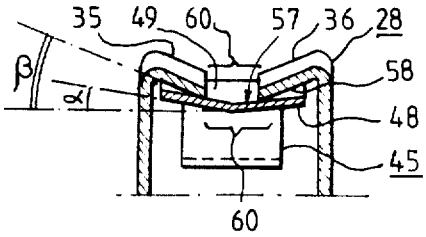
FIGS. 3 and 4 show in a side view and respectively in elevation a detail of the construction of the upper part of the device.
Figure 4:
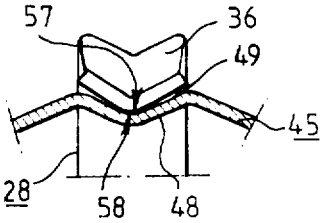

This action which is facilitated by the existence of gap 60 between the two hooks 35, 36, see in particular FIG. 3, is then extremely easy, for the tool cannot slip laterally because of its lateral and transverse cooperation with the edges of the hooks and with the groove.

Figure 6:
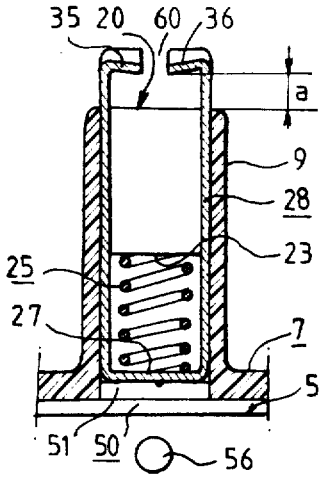
FIG. 6 shows in a side view a local section when this device is deprived of its contact bridge.

When the contact bridge 12 and its plate 45 have been separated from the contact carrier 7, for example to carry out replacement, hooks 35, 36 are no longer in abutment on the blade and crosspiece 27 then bears on the insulating piece 50 so that a distance a separates these hooks from the bearing surface, see FIG. 6.

With this arrangement, a new contact carrier may be easily fitted by sliding it, with its resilient blade, in the surface between the legs of the stirrup and the bottom of the hooks.

When the contact holder is assembled in the factory, armature 5 is not yet associated with the lower cavity 22 of the contact carrier, a spring and a stirrup having first of all to be fitted into each housing.

This operation is greatly facilitated by the presence of the crosspiece in the lower region of the stirrup, for because of its flat shape, this stirrup and the spring may be disposed in vertical equilibrium on the insulating piece, itself disposed on the armature, see FIG. 6, and they may be introduced into the housing by vertical downward movement J of the contact carrier.

If assembly is effected with a reverse contact carrier introduction of the stirrup and of the pressure spring in the housing takes place by gravity in direction L, see FIG. 2, the insulating piece and the armature being then introduced into the housing and respectively, into the cavity, so as to be then finally fixed in this cavity, for example by means of pins, such as 56.

Because of the heating to which the contact bridge and the stirrup are subjected, during repeated use of the switch, it may be feared that the hooks may move away from each other because of deformations of the legs of the stirrups. To get over this drawback, the upper surface of the bottom 57 of the notch 49 in the resilient blade 45 has been given the shape of a very open V in the plane PP', see FIG. 3.

The two hooks which have themselves a V shape adapted to cooperate with notch 49 for providing lateral holding of the contact bridge in the direction G, each comprise a sloping edge 58 which cooperates with the bottom 57 of the notch.

Because of the direction of the slope, and through cooperation between this edge and this bottom, a component of the force of the pressure spring tends to bring the hooks closer to one another, which avoids the above-mentioned drawback.

We claim:

1. A device for resiliently holding a contact bridge, said device comprising: an insulating contact carrier having a base portion and at least one hollow column having a first plane of symmetry and projecting from said base portion, said column having first end portion connected to the said base portion and second free end portion; said column having an inner cavity opening at said second end portion; a bearing surface formed within the said first end portion and a contact pressure spring having first and second end turns, said pressure spring being lodged in the said inner cavity with the second end turn thereof bearing on said bearing surface; an elongate U-shaped stirrup having two substantially parallel legs symmetrically arranged with respect to said first plane of symmetry, said legs having first and second ends and a crosspiece connecting said legs at the first ends thereof, said stirrup being slidably mounted within said cavity with the second ends of its legs projecting out of said cavity and with hooked portions terminating the said second ends, said pressure spring being located between the said legs with its first end turn bearing on the said crosspiece; a generally cup-shaped elongate movable contact bridge symmetrically arranged with respect to a second plane of symmetry of the column and of the stirrup and extending in a direction substantially at right angles to the said second plane of symmetry, said contact bridge passing through the space delimited by said second end portion of the column, the second ends of the legs and the said hooked portions, said hooked portions being oriented towards each other and forming a gap therebetween in said plane of symmetry; a resilient blade symmetrically arranged with respect to the said first and second planes of symmetry and having two end portions bearing on the cup-shaped contact bridge and a central folded portion having first and second pairs of sloping sides respectively converging towards first and second junction lines in the direction of the second end portion of the column, the respective hooked portions having ribs which each engage the two respective sloping sides of the second pair and only one of the sloping sides of the first pair.

2. A device according to claim 1, wherein the said hooked portions each have two sloping sides respectively converging towards a further junction line in the direction of the second end portion of the column, said further junction line being located in the said second plane of symmetry, said further junction line being inclined with respect to the corresponding sloping side of the first pair of sloping sides of the resilient blade.

3. A device according to claim 1, wherein the said base portion has a cavity adapted for receiving the movable armature of an electromagnet, the said cavity of the base portion communicating with the said cavity of the column, the said device further comprising an insulating member having a first part located in the said cavity of the base portion and a second part located in the said cavity of the column, the legs of the said stirrup having a length which substantially exceeds the distance between the said second part and the extremity of the said second end portion of the column.

* * * * *